United States Patent [19]

da Mota

[11] Patent Number: 4,616,708

[45] Date of Patent: Oct. 14, 1986

[54] RISER TENSIONING SYSTEM

[75] Inventor: Augusto L. C. da Mota, The Hague, Netherlands

[73] Assignee: Shell Oil Company, Houston, Tex.

[21] Appl. No.: 800,185

[22] Filed: Nov. 21, 1985

[30] Foreign Application Priority Data

Jan. 25, 1985 [GB] United Kingdom ..... 8501920

[51] Int. Cl.[4] ..... E21B 19/09

[52] U.S. Cl. ..... 166/355; 175/7; 254/392

[58] Field of Search ..... 166/350–355, 166/345; 175/7, 5, 27; 254/392, 390, 277, 900

[56] References Cited

U.S. PATENT DOCUMENTS 3,145,775 8/1964 McCarty ..... 175/7 X 3,369,600 2/1968 Bohlmann, Jr. ..... 175/27 X 4,272,059 6/1981 Noerager et al. ..... 166/355 X 4,487,150 12/1984 Shanks ..... 175/5 X 4,545,437 10/1985 Denison ..... 166/345

*Primary Examiner*—Stephen J. Novosad

*Assistant Examiner*—David J. Bagnell

[57] ABSTRACT

A riser tensioning and recoil system for a riser extended between a floating platform and a submerged riser base comprises at least one riser tensioning cable which is operatively connected to the riser and to a collar which is slidably arranged around the riser. To establish a controlled recoil of the riser, stop means are provided that restrict axial movement of the collar relative to the riser after the riser has been lifted from the riser base, thereby enabling the collar to gradually decelerate the vertical movement of the riser.

10 Claims, 3 Drawing Figures

RISER TENSIONING SYSTEM

RELATED APPLICATIONS

This application is related to two previously filed applications, both entitled "Drilling Riser Locking Apparatus and Method", both filed Apr. 9, 1984, the inventor for both applications being Early B. Denison. One application is identified with Ser. No. 597,994, the other application is identified with Ser. No. 597,995.

BACKGROUND OF THE INVENTION

1. Field of the Invention

The invention relates to a system for tensioning a riser extending between a floating offshore platform and a submerged riser base.

2. Description of the Prior Art

In the offshore oil and gas industry exploratory well drilling operations are generally carried out from floating drilling platforms. These platforms may consist of a ship-like hull or of a semi-submersible vessel in which a central hull opening or "moon-pool" is created through which a riser extends in a downward direction. The riser may consist of a large diameter pipe column which is at its lower end secured to a subsea wellhead assembly and which is at the upper end thereof connected to the platform by means of a riser tensioning system. The riser tensioning system generally comprises a cable and sheave mechanism that applies an upward force to the riser and that allows the floating platform to make oscillating motions relative to the stationary riser.

In deepwater areas where oil or gas is produced from submerged wells floating production platforms may be used to which one or more production risers are connected by riser tensioning systems similar to those used on drilling platforms.

The production riser may be secured at the lower end thereof to a wellhead or to another kind of submerged riser base located on or at a distance above the water-bottom.

If the oscillating movements of the platform due to wind, waves, and current become too rough, drilling or production operations have to be interrupted and the riser disconnected from the wellhead or riser base.

Under such circumstances it is a general practice to disconnect the riser from the riser base by activating a quick release coupling at the lower end of the riser and to subsequently allow the riser tensioning system to lift the disconnected riser quickly from the riser base thereby avoiding sweeping movements of the lower end of the riser that may cause damage to the subsea equipment at or near the riser base. Then, a short while after disconnection, the lifting force applied by the tensioning system to the riser is usually reduced by manual control to avoid increases in the vertical movement of the riser to such an extent that the upper end of the riser collides with the equipment arranged on the platform above the riser, such as the rotaty table.

An apparatus need be developed however that automatically compensates for the upward recoil motion of the riser when it is released from the wellhead.

SUMMARY OF THE INVENTION

An object of the invention is to provide a riser tensioning system which is able to allow the recoil of a riser, after disconnection thereof from the riser base, to such a height so that no contact between the disconnected riser and the riser base will occur. The riser tensioning system is also able to subsequently reduce the vertical speed of the recoiling riser in response to the vertical displacement thereof relative to the platform, so that no contact between the upper end of the disconnected riser and the equipment arranged on the platform above the riser results.

The riser tensioning system according to the invention comprises at least one riser tensioner cable rotatably engaged with a set of sheaves that form part of a heave compensator unit mounted on the platform, the riser tensioner cable being operatively connected to the riser and to a collar which is slidably arranged around the riser, wherein stop means are provided to restrict axial movement of the collar relative to the riser if the riser after disconnection thereof from the base is pulled in an upward direction by means of the tensioner cable.

These and other features, objects, and advantages of the present invention will become apparent from the following detailed description, wherein reference is made to the Figures in the accompanying drawings.

DESCRIPTION OF THE PREFERRED EMBODIMENT

Figure 1:
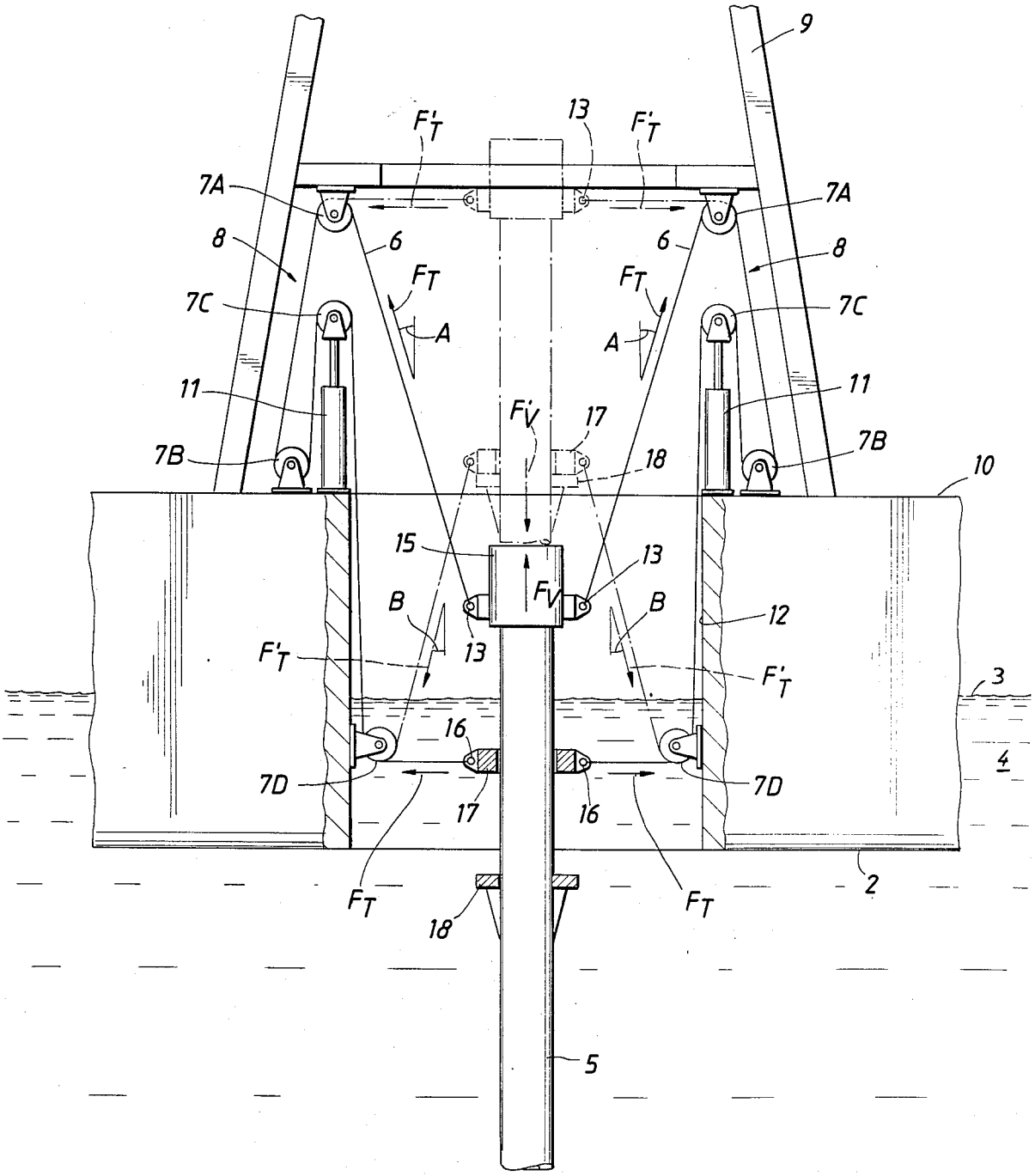
FIG. 1 is a schematic representation of a central hull opening in a floating platform, in which opening a riser is suspended by means of a riser tensioning system embodying the invention.

FIG. 1 shows schematically the central hull opening 1 or "moon-pool" of a platform 2 floating at the surface 3 of a body of water 4. In the hull opening 1 a riser 5 is supended by means of two riser tensioner cables 6 that form part of a riser tensioning system embodying the invention. Each cable 6 runs along a set of four sheaves 7A–D that form part of a heave compensator unit 8. The sheaves 7A are secured to a derrick 9 mounted on the platform deck 10, whereas the sheaves 7B are secured directly to the deck 10. Each sheave 7C is arranged on top of a hydropneumatic piston cylinder assembly 11 well known to the art mounted vertically on the platform deck 10 adjacent to the central hull opening 1. The sheaves 7D are each secured to the wall 12 of the platform 2 that surrounds the central hull opening 1.

The cables 6 are each at one end thereof connected to a pulling eye 13 which is connected to a top section 15 of the riser 5 and at the other end thereof to a pulling eye 16. The pulling eyes 16 are mounted on a ring-shaped collar 17 which is slidably arranged around the riser 5 at a selected distance above a stop shoulder 18. As is well known to the art the hydropneumatic piston cylinder assemblies 11 apply a predetermined vertical force to the sheaves 7C, which causes the riser tensioner cables 6 to be tensioned in a resilient mode at a predetermined tension force $F_T$.

In the situation shown in FIG. 1 the section of each tensioner cable 6 extending between the pulling eye 13 at the riser top 15 and the derrick sheave 7A is oriented at an angle A relative to the vertical, so that the vertical force $F_V$ applied by the two tensioner cables 6 to the riser top 15 equals two times the quantity $F_T \cdot \cos A$.

During normal utilization of the platform 2 drilling operations are performed through the riser assembly. The riser tensioning system allows the floating platform 2 to make oscillating movements relative to the stationary riser 5 and also applies an upward force to the riser 5 via the pulling eyes 13 at the riser top 15 in order to prevent buckling of the riser 5.

As the weight of the collar 17 is low in comparison to the tension force $F_T$ in the riser tensioning cables 6 it will be understood that the collar 17 is maintained at approximately the same vertical level as the sheaves 7D within the hull opening 1. Hence the collar 17 will together with the platform 2 move up and down relative to the riser and the tensioner cable 6 sections between the pulling eyes 16 and the hull-sheaves 7D will remain stationary in a substantially horizontal and radial direction. The vertical distance between the stop shoulder 18 on the riser 5 and the collar 17 is selected such that during normal operation the collar 17 does not come into contact with the shoulder 18.

If the riser 5 is to be disconnected from the riser base (not shown) the quick release coupling (not shown) at the lower end of the riser 5 is activated, which allows the vertical force $F_V = 2\ F_T \cdot \cos A$ applied by the riser tensioning cables 6 via the pulling eyes 13 to the riser top 15 to lift the riser 5 from the riser base. It is understood that the tension force $F_T$ in the riser tensioning cables 6 is selected such that the vertical force $F_V$ exceeds the weight of the riser 5 in its almost entirely submerged position.

Once the riser 5 has been raised to such a height that the stop shoulder 18 engages the collar 17, the collar 17 will be urged to follow the vertical motion of the riser 5. This will cause the collar 17 to be raised above the level of the hull sheaves 7D and consequently the tensioner cables 6 will apply a downward force to the riser 5 via the collar 17 and stop shoulder 18.

In the situation shown in broken lines in FIG. 1 the collar 17 has been raised to such a height that the sections of the riser tensioner cables 6 extending between the collar 17 and the hull sheaves 7D are oriented at an angle B relative to the vertical. It is obvious that due to the tension force $F_T'$ in the tensioner cables 6 a downward force $F_V' = 2\ F_T' \cdot \cos B$ is applied via the collar 17 to the riser 5, which force $F_V'$ will decelerate the vertical movement of the riser 5.

As in the situation shown in broken lines the riser 5 has been raised such that pulling eyes 13 of the riser top 15 are located at the same vertical level as the derrick-sheaves 7A and therefore no vertical force is applied by the tensioner cables 6 to the riser top 15.

It will be appreciated that if the riser 5 is moved from the position shown in the solid lines to the position shown in broken lines the upward force $F_V$ applied by the tensioner cables 6 to the riser top 15 is gradually turned down from $F_V$ to zero whereas the downward force applied via the collar 17 to the riser 5 is gradually raised from zero to $F_V'$. The gradual transformation during the recoil procedure of the upward force into a downward force applied by the tensioner cables 6 to the riser 5 stops the vertical movement of the riser 5 at such a level that any risk on collision of the recoiling riser 5 with the rotaty table at the drilling floor (not shown) is avoided.

The controlled deceleration of the recoiling riser 5 in response to the vertical displacement thereof relative to the platform 2 enhances safety of the recoil procedure considerably.

Figure 2:
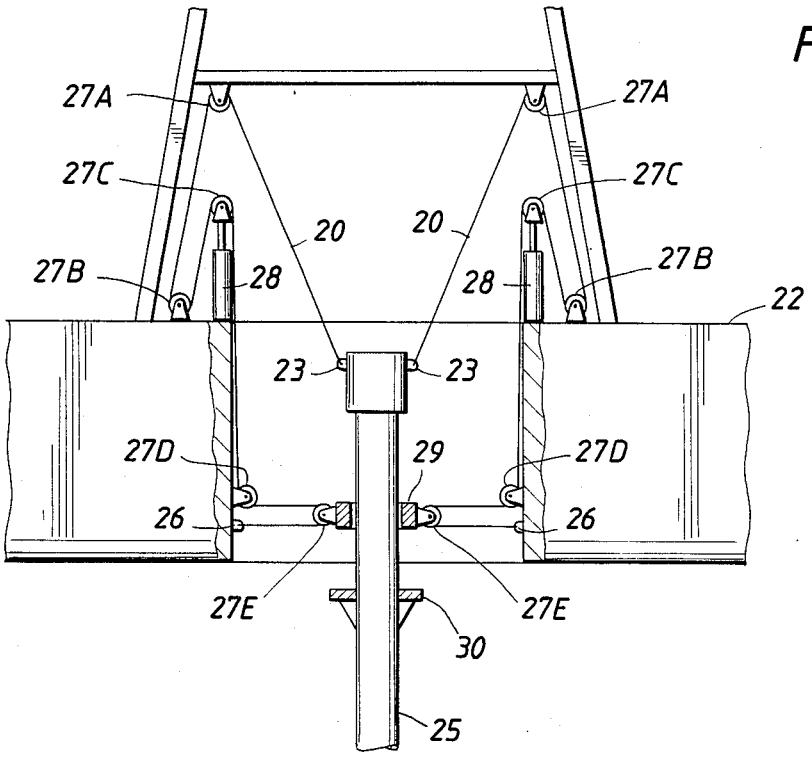
FIG. 2 is a schematic representation of a riser suspended in a central hull opening of a platform by means of an alternative embodiment of a riser tensioning system according to the invention.

In the riser tensioning system shown in FIG. 2 each riser tensioner cable 20 is secured at one end thereof to a pulling eye 23 near the top of a riser 25 and at the other end to a pulling eye 26 which is mounted on the wall of the central hull opening of a floating platform 22. Each cable 20 runs along a set of five sheaves 27A–E. The sheaves 27A are mounted on the derrick, the sheaves 27B on the platform deck, the sheaves 27C on top of a hydropneumatic piston-cylinder assembly 28 and the sheaves 27D on the wall of the central hull opening. The sheaves 27E are mounted at the outer circumference of a ring-shaped collar 29 which is mounted at a selected distance above a stop shoulder 30 on the riser 25.

Figure 3:
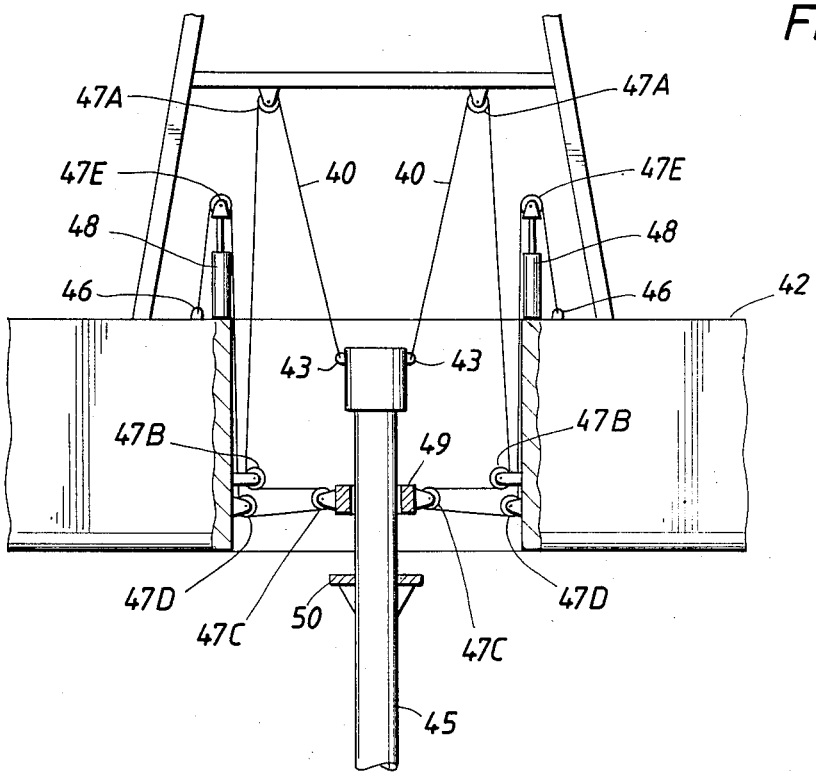
FIG. 3 is a schematic representation of a riser suspended in a central hull opening of a platform by means of yet another configuration of a riser tensioning system embodying the invention.

In the riser tensioning system shown in FIG. 3 each riser tensioner cable 40 is secured at one end thereof to a pulling eye 43 near the top of a riser 45 and at the other end thereof to a pulling eye 46 which is mounted on the deck of a floating platform 42. Each cable runs along a set of five sheaves 47A–E. The sheaves 47A are mounted on the derrick and the sheaves 47B and 47D are mounted above each other on the wall of the hull opening. The sheaves 47E are each mounted on top of a hydropneumatic piston-cylinder assembly 48 and the sheaves 47C are mounted at the outer circumference of a ring-shaped collar 29 which is mounted at a selected distance above a stop should 50 on the riser 45.

In the alternative riser tensioning systems shown in FIG. 2 and 3 the assemblies of the riser tensioning systems differ from the system shown in FIG. 1 but the operation of these systems is similar to system of FIG. 1 as during the recoil procedure in response to the vertical displacement of the riser 5,25,45 relative to the platform the upward force applied by the riser tensioner cables 6, 20, 40 to the riser 5, 25, 45 is gradually turned down to a downward force.

It will be understood that the vertical force applied by the riser tensioner cables 20, 40 of FIG. 2 and 3 via the collar 29, 49 to the riser 25, 45 in response to the vertical displacement of the riser 25, 45 during the recoil procedure will increase more rapidly than the downward force applied via the collar 17 to the riser 5 shown in FIG. 1. It is obvious that the more rapid increase of the downward force is caused by the fact that in the assemblies of FIG. 2 and 3 the resulting force applied by each collar-sheave 27E, 47C to the collar 29, 49 is twice the tension force in the tensioner cable 20, 40 whereas the force applied by each tensioner cable 6 to the collar 17 shown in FIG. 1 is only once the tension force.

It will further be understood that the riser tensioning systems shown in the drawings are not the only mechanisms available that can assure that a gradually increasing downward force is applied by the riser tensioner cables 6, 20, 40 to the riser 5, 25, 45 in response to the vertical displacement of the riser 5, 25, 45 during the recoil procedure. For instance the pattern of the sheaves 7A–D, 27A–E, 47A–E and the course of the tensioner cables 6, 20, 40 may take many alternative forms. Moreover instead of a ring-shaped collar 17, 29, 49 a horseshoe-shaped collar (not shown) may be used and the collar may be provided at the inner circumference thereof with a set of guide wheels that allow axial displacement of the collar relative to the riser but prevent the collar to displace in a radial sense relative to the riser. Furthermore the collar may be provided at the inner circumference thereof with friction means that clamp the collar to the riser after disconnection of the riser from the riser base. In this manner the arrangement of a stop shoulder below the collar can be avoided.

Finally it will be understood that the riser may also be arranged along a "moon-pool".

Many other variations and modifications may be made in the apparatus and techniques hereinbefore described, both by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

I claim:

1. Riser tensioning system for a riser extending between a platform floating in a body of water and a submerged riser base, the system comprising at least one riser tensioner cable running along a set of sheaves that form part of a heave compensator unit mounted on the platform, the riser tensioner cable being operatively connected to the riser and to a collar which is slidably arranged around the riser, wherein stop means are provided to restrict axial movement of the collar relative to the riser if the riser after disconnection thereof from the base is pulled in upward direction by means of the tensioner cable.

2. The riser tensioning system of claim 1, wherein the stop means comprise a stop shoulder which is mounted on the riser at a selected distance below the collar.

3. The riser tensioning system of claim 1, wherein at least one sheave of the heave compensator unit is located, when seen along the length of the tensioner cable, between the locations where the cable is operatively connected to the riser and to the collar.

4. The riser tensioning system of claim 3, wherein a central hull opening through which the riser extends is defined through the platform, said sheave being mounted on a wall of said hull opening.

5. The riser tensioning system of claim 1, wherein the tensioner cable is secured at one end thereof to the collar.

6. The riser tensioning system of claim 5, wherein the tensioner cable is secured at the other end thereof to the riser.

7. The riser tensioning system of claim 1. wherein the tensioner cable runs along a sheave mounted on the collar.

8. The riser tensioning system of claim 7, wherein the tensioner cable is at one end thereof connected to the platform and at a second end thereof to the riser and wherein, when seen along the length of the cable, the set of sheaves of the heave compensator unit is located between the sheave mounted on the collar and said second end of the cable.

9. The riser tensioning system of claim 1, wherein the collar is ring-shaped and provided with guide means that allow axial displacement of the collar relative to the riser but prevent the collar to displace in a radial sense with respect to the riser.

10. The riser tensioning system of claim 9, wherein the guide means comprise a series of guide wheels rolling along the outer surface of the riser.

* * * * *